US011109147B2

(12) United States Patent
Xiao et al.

(10) Patent No.: US 11,109,147 B2
(45) Date of Patent: Aug. 31, 2021

(54) SOUND GENERATING DEVICE

(71) Applicant: AAC Technologies Pte. Ltd., Singapore (SG)

(72) Inventors: Bo Xiao, Shenzhen (CN); Ronglin Linghu, Shenzhen (CN); Xiaodong Liu, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 14 days.

(21) Appl. No.: 16/702,553

(22) Filed: Dec. 4, 2019

(65) Prior Publication Data

US 2020/0213719 A1 Jul. 2, 2020

(30) Foreign Application Priority Data

Dec. 28, 2018 (CN) ..... 201822240249.6

(51) Int. Cl.
*H04R 1/28* (2006.01)
*H04R 17/00* (2006.01)

(52) U.S. Cl.
CPC ..... *H04R 1/2834* (2013.01); *H04R 17/00* (2013.01)

(58) Field of Classification Search
CPC ... H04R 9/00; H04R 9/02; H04R 9/06; H04R 11/00; H04R 11/02; H04R 17/00; H04R 17/005; H04R 23/00; H04R 23/02
See application file for complete search history.

(56) References Cited

U.S. PATENT DOCUMENTS 4,389,548 A * 6/1983 Morikawa ..... H04R 17/00 381/190
5,062,139 A * 10/1991 Christensen ..... H04R 17/00 381/184
5,652,801 A * 7/1997 Paddock ..... H04R 17/00 381/173
10,225,661 B2 * 3/2019 Pan ..... H04R 9/025
2011/0069859 A1 * 3/2011 Kobayashi ..... H04R 9/10 381/400
2015/0373436 A1 * 12/2015 Chu ..... H04R 1/24 381/162
2018/0220236 A1 * 8/2018 Sato ..... H04R 7/18

FOREIGN PATENT DOCUMENTS

CN 204518061 B1 7/2015
CN 205491057 B1 8/2016

OTHER PUBLICATIONS

PCT search report dated Jan. 23, 2020 by SIPO in related PCT Patent Application No. PCT/CN2019/113327 (10 Pages).

* cited by examiner

*Primary Examiner* — Walter F Briney, III
(74) *Attorney, Agent, or Firm* — W&G Law Group LLP

(57) ABSTRACT

The present invention provides a sound generating device, including a housing and a vibration system accommodated in the housing, the vibration system including a diaphragm and a driving unit for driving the diaphragm to vibrate and generate sound. The driving unit includes a piezoelectric driving unit and a moving iron driving unit coupled in parallel with the piezoelectric driving unit, the piezoelectric driving unit including a piezoelectric sheet, the moving iron driving unit including a coil and a magnetic steel. The piezoelectric driving unit and the moving iron driving unit jointly drive the diaphragm to vibrate and sound.

16 Claims, 4 Drawing Sheets

SOUND GENERATING DEVICE

TECHNICAL FIELD

The present disclosure relates to the field of vibrating acoustic technology, in particular to a sound generating device.

BACKGROUND

Traditionally, a sound generating device includes a housing and a vibration system accommodated in the housing. The vibration system generally includes a diaphragm and a single drive structure for driving the diaphragm to vibrate and generate sound.

Obviously, the sound generating device with the single drive structure has small driving force for driving the diaphragm to vibrate and generate sound, low vibration amplitude and poor product sensitivity, causing occurrence of defects such as a product distortion and the like.

DETAILED DESCRIPTION

The present disclosure is described in detail below with reference to FIGS. 1 to 4.

Figure 1:
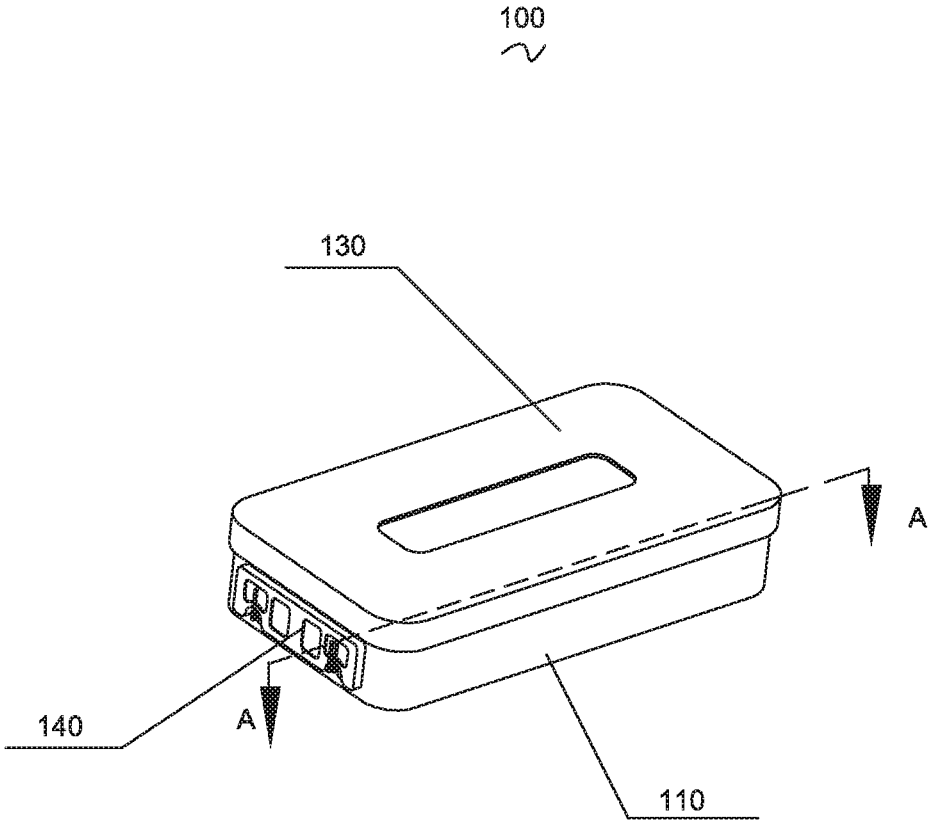
FIG. 1 is a perspective structural view of a sound generating device in the present disclosure.
Figure 2:
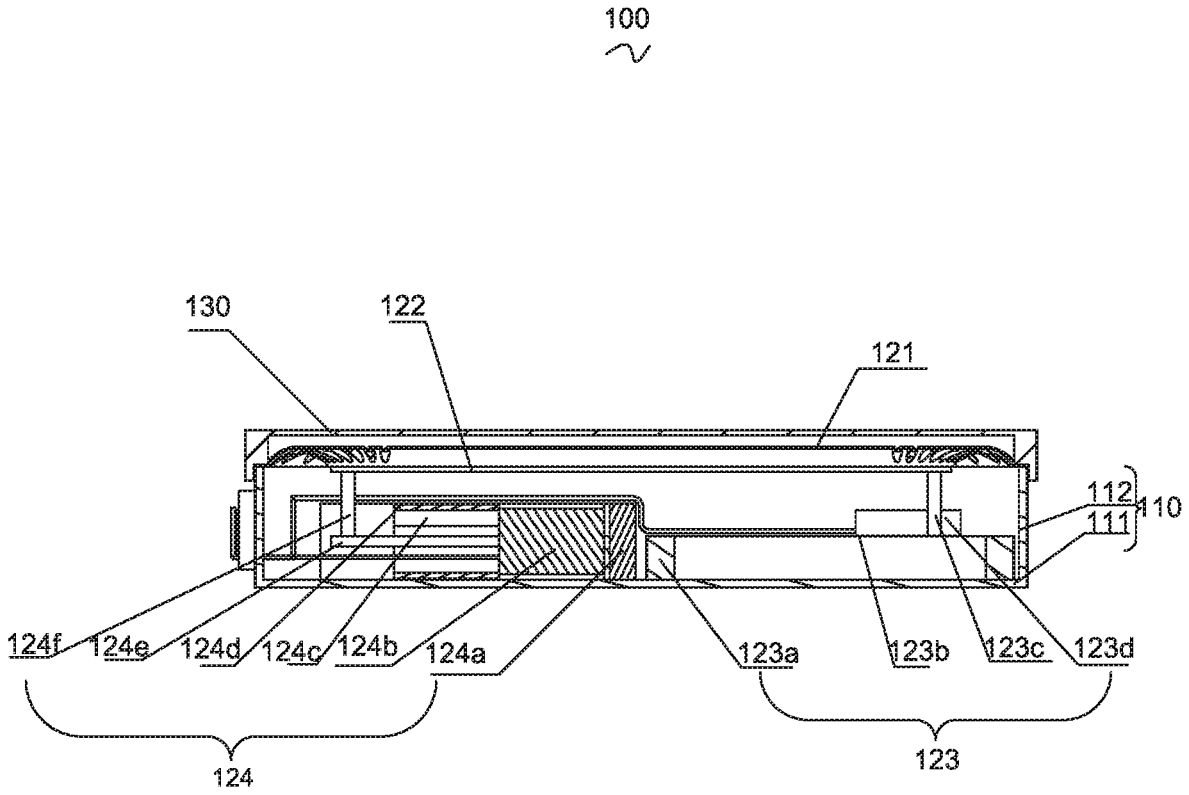
FIG. 2 is a sectional view along the AA direction of FIG. 1.

An embodiment of the present disclosure relates to a sound generating device. As shown in FIG. 1 and FIG. 2, the sound generating device 100 includes a housing 110, a vibration system accommodated in the housing 110, a cover plate 130 covering on the housing 110, and a circuit board 140. Here, the vibration system 120 includes a diaphragm 120, and a driving unit for driving the diaphragm 120 to vibrate and generate sound. The diaphragm 120 includes a dome 122 and a suspension 121 formed by bending and extending outward from the dome 122. The driving unit includes a piezoelectric driving unit 123 and a moving iron driving unit 124 coupled in parallel with the piezoelectric driving unit 123. The piezoelectric driving unit 123 includes a piezoelectric sheet 123*b*, and the moving iron driving unit 124 includes a coil 124*b* and a magnetic steel 124*d*. The piezoelectric driving unit 123 and the moving iron driving unit 124 jointly drive the diaphragm 121 to vibrate and generate sound.

In a sound generating device 100 with a structure of this embodiment, a driving unit of a vibration system 120 includes a piezoelectric driving unit 123 and a moving iron driving unit 124 coupled in parallel with the piezoelectric driving unit 123. The piezoelectric driving unit 123 includes a piezoelectric sheet 123*b*, and the moving iron driving unit 124 includes a coil 124*b* and a magnetic steel 124*d*. The piezoelectric driving unit 123 and the moving iron driving unit 124 jointly drive the diaphragm 121 to vibrate and generate sound. In this way, compared with a traditional sound generating device with a single drive structure, the sound generating device 100 of this embodiment may effectively increase driving force, increase vibration amplitude, enhance product sensitivity, broaden corresponding range, and at the same time, the sound generating device 100 with a dual drive structure may also effectively increase driving fulcrum, improve vibration balance, and improve product distortion.

Figure 3:
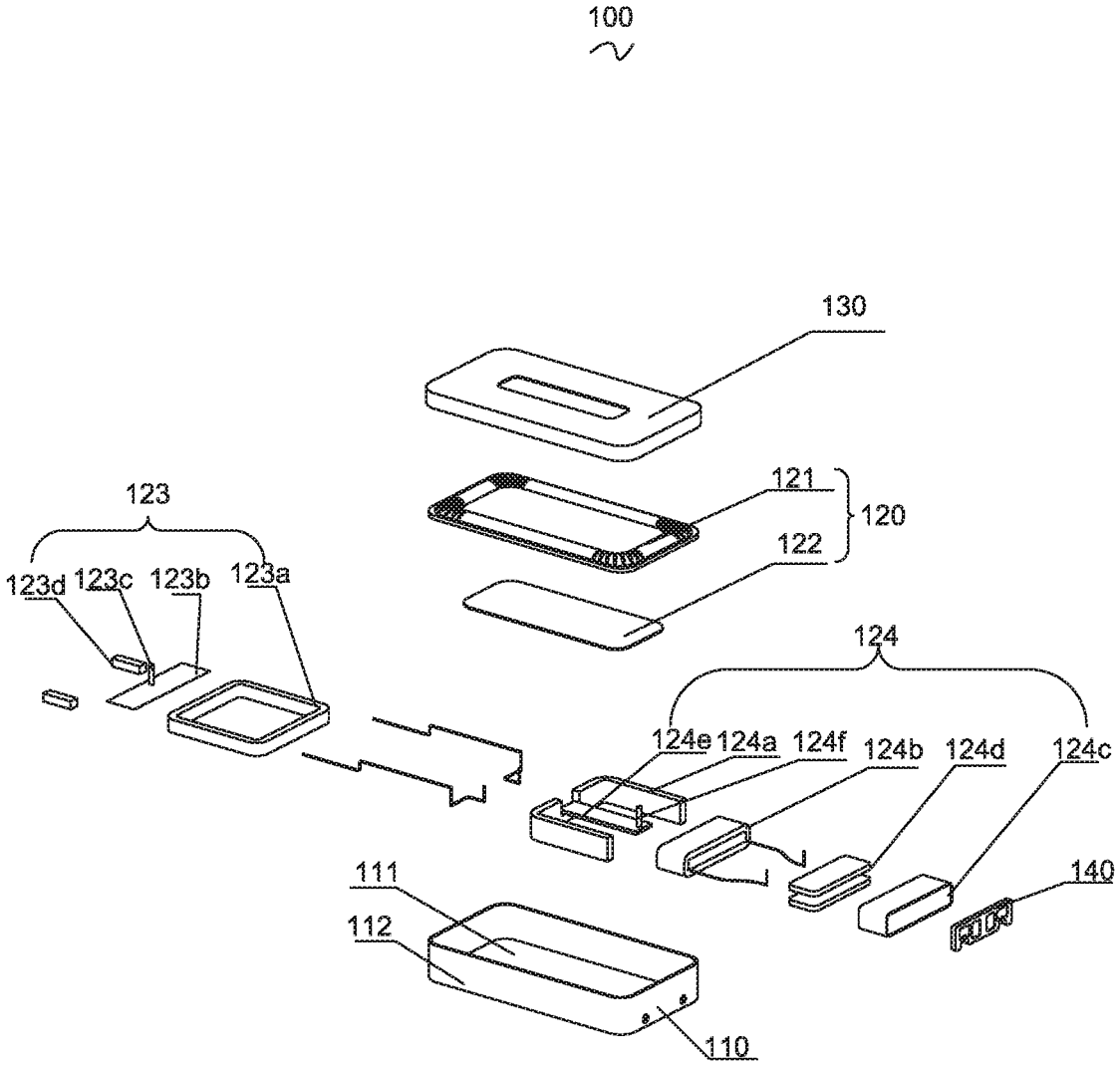
FIG. 3 is an exploded perspective view of a sound generating device in the present disclosure.
Figure 4:
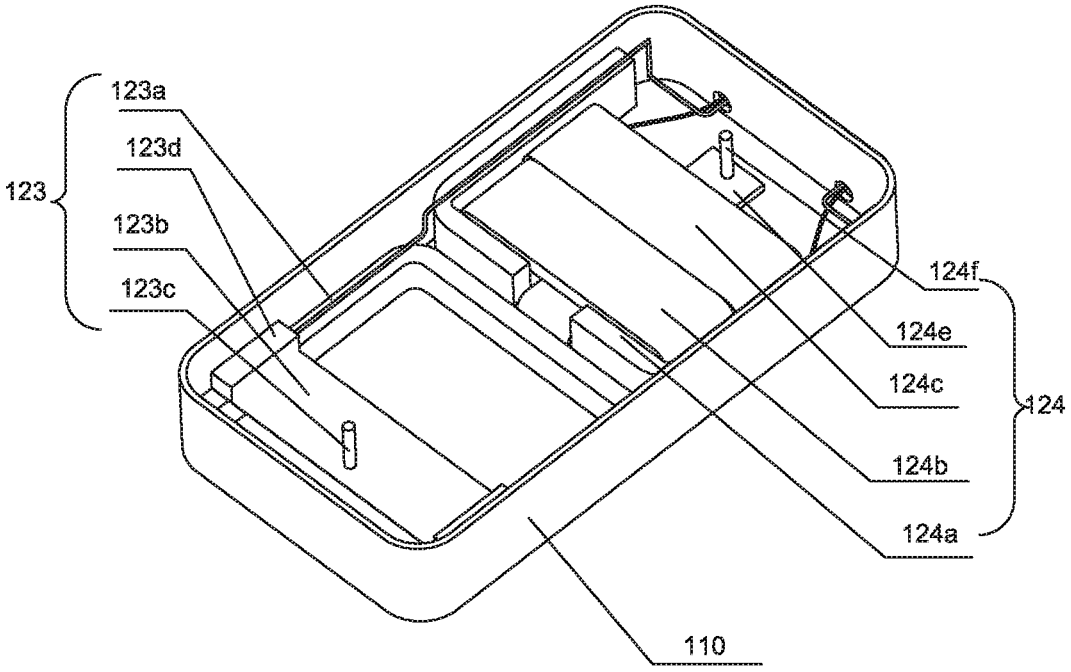
FIG. 4 is a schematic local view of a sound generating device in the present disclosure.

Specifically, as shown in FIGS. 2, 3 and 4, the piezoelectric driving unit 123 includes a first base 123*a* fixed to the housing 110 and fixed to both ends of the piezoelectric sheet 123*b*, a first support 123*c* extending from the piezoelectric sheet 123*b* toward the diaphragm 121 and connected to the diaphragm 121, and a bump 123*d* fixing the piezoelectric sheet 123*b* to the first base 123*a*. In this way, piezoelectric effect of the piezoelectric sheet 123*b* may cause the piezoelectric sheet 123*b* to distort and deform, thereby driving first support 123*c* located on the piezoelectric sheet 123*b* to drive the diaphragm 121 to vibrate and generate sound.

As shown in FIGS. 2 and 4, the first support 123*c* may be of a columnar structure. Of course, in addition to this, the first support 123*c* may be of other structures, and may be determined in accordance with actual needs. In order to simplify the structure of the piezoelectric driving unit 123, the first support 123*c* may be integrally formed with the piezoelectric sheet 123*b*.

As shown in FIGS. 2, 3 and 4, the moving iron driving unit 124 includes a second base 124*a* fixed to the housing 110 and accommodating the coil 124*b*, a pole core 124*c* fixed to the housing 110 and in an annular shape. The magnetic steel 124*d* is attached to both sides of the pole core 124*c*, and the magnetic steel 124*d* extends along a direction that is perpendicular to the vibration direction of the diaphragm 121. The moving iron driving unit 124 further includes a tongue-like plate 124*e* extending from the second base 124*a* through the coil 124*b* and the pole core 124*c*, and a second support 124*f* extending from the tongue-like plate 124*e* toward the diaphragm 121 and connected to the diaphragm 121. In this way, when the current passes through the coil 124*b*, the tongue-like plate 124*e* is polarized, so that the tongue-like plate 124*e* may interact with the magnetic field of the magnetic steel 124*d*, thus the tongue plate 124*e* is pushed to generate a corresponding vibration. The vibration of the tongue-like plate 124*e* may drive the second support 124*f* disposed on the tongue-like plate 124*e* to vibrate, and may drive the diaphragm 121 to vibrate and generate sound.

In order to simplify the structure of the moving iron driving unit 124, the tongue-like plate 124*e* may be integrally formed with the second base 124*a*. Further, the second support 124*f* may also be integrally formed with the tongue-like plate 124*e*.

As shown in FIGS. 2 and 3, the housing 110 includes a bottom wall 111 and a side wall 112 formed by bending and extending from the bottom wall 111. In order to improve performance of the vibration to generate sound of the sound generating device 100, a vertical distance between the tongue-like plate 124*e* and the bottom wall 111 is equal to a vertical distance between the piezoelectric sheet 123*b* and the bottom wall 111. Further, a length of the first support 123*c* is equal to a length of the second support 124*f*. Furthermore, the piezoelectric sheet 123*b* and the tongue-like plate 124*e* both have a midline, and the first support 123*c* and the second support 124*f* are located at the corresponding midline positions respectively.

The foregoing merely describes embodiments of the present disclosure, and it should be noted that those skilled in the art may further make improvements without departing from the inventive concept of the present disclosure, and all these improvements fall within the protection scope of the present disclosure.

What is claimed is:

1. A sound generating device, comprising a housing, a vibration system accommodated in the housing and a circuit board, the vibration system comprising a diaphragm and a driving unit for driving the diaphragm to vibrate and generate sound, wherein the driving unit comprises a piezoelectric driving unit and a moving iron driving unit coupled in electrical parallel with the piezoelectric driving unit;

wherein the piezoelectric driving unit comprises a piezoelectric sheet, and the moving iron driving unit comprises a coil and a magnetic steel; and the piezoelectric driving unit and the moving iron driving unit jointly drive the diaphragm to vibrate and generate sound, the piezoelectric driving unit comprises a first base fixed to the housing and fixed to both ends of the piezoelectric sheet, a first support extending from the piezoelectric sheet toward the diaphragm and connected to the diaphragm, and a bump fixing the piezoelectric sheet to the first base.

2. The sound generating device in accordance with claim 1, wherein the first support is integrally formed with the piezoelectric sheet.

3. The sound generating device in accordance with claim 1, wherein the moving iron driving unit comprises a second base fixed to the housing and accommodating the coil, a pole core fixed to the housing and in an annular shape;

the magnetic steel is attached to both sides of the pole core and the magnetic steel extends along a direction that is perpendicular to the vibration direction of the diaphragm; and the moving iron driving unit further comprises a tongue-like plate extending from the second base through the coil and the pole core, and a second support extending from the tongue-like plate toward the diaphragm and connected to the diaphragm.

4. The sound generating device in accordance with claim 2, wherein the moving iron driving unit comprises a second base fixed to the housing and accommodating the coil, a pole core fixed to the housing and in an annular shape;

the magnetic steel is attached to both sides of the pole core and the magnetic steel extends along a direction that is perpendicular to the vibration direction of the diaphragm; and the moving iron driving unit further comprises a tongue-like plate extending from the second base through the coil and the pole core, and a second support extending from the tongue-like plate toward the diaphragm and connected to the diaphragm.

5. The sound generating device in accordance with claim 3, wherein the tongue-like plate is integrally formed with the second base.

6. The sound generating device in accordance with claim 4, wherein the tongue-like plate is integrally formed with the second base.

7. The sound generating device in accordance with claim 3, wherein the second support is integrally formed with the tongue-like plate.

8. The sound generating device in accordance with claim 4, wherein the second support is integrally formed with the tongue-like plate.

9. The sound generating device in accordance with claim 3, wherein the housing comprises a bottom wall and a side wall formed by bending and extending from the bottom wall, and a vertical distance between the tongue-like plate and the bottom wall is equal to a vertical distance between the piezoelectric sheet and the bottom wall.

10. The sound generating device in accordance with claim 4, wherein the housing comprises a bottom wall and a side wall formed by bending and extending from the bottom wall, and a vertical distance between the tongue-like plate and the bottom wall is equal to a vertical distance between the piezoelectric sheet and the bottom wall.

11. The sound generating device in accordance with claim 3, wherein a length of the first support is equal to a length of the second support.

12. The sound generating device in accordance with claim 4, wherein a length of the first support is equal to a length of the second support.

13. The sound generating device in accordance with claim 3, wherein the piezoelectric sheet and the tongue-like plate each have a midline, and the first support and the second support are located at the corresponding midline positions respectively.

14. The sound generating device in accordance with claim 4, wherein the piezoelectric sheet and the tongue-like plate each have a midline, and the first support and the second support are located at the corresponding midline positions respectively.

15. The sound generating device in accordance with claim 3, wherein the diaphragm comprises a dome and a suspension formed by bending and extending outward from the dome, and the first support and the second support are both abutted against the dome.

16. The sound generating device in accordance with claim 4, wherein the diaphragm comprises a dome and a suspension formed by bending and extending outward from the dome, and the first support and the second support are both abutted against the dome.

* * * * *